US009062435B2

(12) United States Patent
Hylén

(10) Patent No.: US 9,062,435 B2
(45) Date of Patent: Jun. 23, 2015

(54) BOOM UPLOCK ARRANGEMENT

(75) Inventor: Roger Hylén, Garphyttan (SE)

(73) Assignee: Atlas Copco Rock Drills AB, Orebro (SE)

( * ) Notice: Subject to any disclaimer, the term of this patent is extended or adjusted under 35 U.S.C. 154(b) by 651 days.

(21) Appl. No.: 11/922,998

(22) PCT Filed: Jun. 19, 2006

(86) PCT No.: PCT/SE2006/050209

§ 371 (c)(1),
(2), (4) Date: Dec. 28, 2007

(87) PCT Pub. No.: WO2007/018470

PCT Pub. Date: Feb. 15, 2007

(65) Prior Publication Data

US 2009/0127218 A1 May 21, 2009

(30) Foreign Application Priority Data

Aug. 11, 2005 (SE) ..... 0501798

(51) Int. Cl.

| | |
|---|---|
| ***B66C 23/90*** | (2006.01) |
| ***E02F 9/24*** | (2006.01) |
| ***E02F 3/38*** | (2006.01) |

(52) U.S. Cl.

CPC . *E02F 9/24* (2013.01); *B66C 23/90* (2013.01); *E02F 3/38* (2013.01)

(58) Field of Classification Search

USPC ..... 414/680, 694; 296/3, 57.1, 60; 292/4, 292/57, 60

See application file for complete search history.

(56) References Cited

U.S. PATENT DOCUMENTS

| | | | | | |
|---|---|---|---|---|---|
| 1,770,751 | A | * | 7/1930 | Hall | 292/57 |
| 2,778,513 | A | | 1/1957 | Braun | |
| 2,829,001 | A | * | 4/1958 | Leaphart | 296/57.1 |
| 3,396,863 | A | | 8/1968 | Borer et al. | |
| 3,730,362 | A | * | 5/1973 | Hurlburt et al. | 414/697 |
| 4,189,278 | A | | 2/1980 | Dewey | |
| 4,355,944 | A | | 10/1982 | Lorenc | |
| 4,388,038 | A | * | 6/1983 | Freitag | 414/685 |
| 4,404,695 | A | * | 9/1983 | Camp | 425/3 |
| 4,793,764 | A | * | 12/1988 | Hamm | 414/686 |

* cited by examiner

*Primary Examiner* — Scott Lowe
(74) *Attorney, Agent, or Firm* — Mark P. Stone

(57) ABSTRACT

Boom uplock arrangement for a loader, said loader comprising a least one movable boom arm (20) and a support means (70), wherein the boom arm (20) is provided with a horizontal, transversal through going hole (21), and a locking pin (42) movably arranged in the hole (21), the locking pin (42) is elongated, and having a first (421) and a second (422) end the locking pin (42) is movable in its longitudinal direction between a passive and an active position; wherein the passive position of the locking pin (42) enables movement of the boom arm (20) past the support means (70), and the active position of the locking pin (42) prevents movement of the boom arm (20) past the support means (70). The invention is characterized in that the locking pin (42) is provided with a protruding maneuver stick (48) arranged in the vicinity of the first end (421) of the locking pin (42), enabling maneuvering of the locking pin (42) between the passive and active positions.

18 Claims, 3 Drawing Sheets

BOOM UPLOCK ARRANGEMENT

TECHNICAL FIELD

The present invention relates to a boom uplock arrangement for a loader. The present invention also relates to a loader comprising such boom uplock arrangement.

BACKGROUND

Loader vehicles are generally exposed to serious stress and strain in its operating environment. Especially vehicles operating in mines; running 24-hours in a rough and dangerous environment, need to be equipped with powerful, durable and secure constructions of simple mechanical details. The more complicated construction, the larger risk for operational stoppage. Loaders and trucks used to remove masses of rock from mines generally have a load capacity of 1-20 tons and 20-50 tons respectively. Thus, the mining environment make great demands on the vehicles, both constructional, ergonomic and safety demands.

For different kinds of loaders for moving of material, such as mining loaders and other front end loaders, it is sometimes desirable to safely prevent the boom from unintentionally lowering from an elevated position, as an example when an driver needs to perform some kind of service or maintenance beneath the boom arm. The boom arms with its bucket (sometimes with load) must be raised and kept in an elevated position, to facilitate such service to be effected. Thus, the elevated boom with its bucket presents a dangerous hazard for the driver while carrying out the service. Different kinds of arrangements for preventing the boom from lowering beneath a certain level or to retain them in a certain position have therefore been used within the field.

Some of the known arrangements acts on the boom cylinder, preventing it from retracting. Another known conventional arrangement of preventing the boom from lowering beneath a certain position is to insert a steel bar or wood log transversally between the boom and the boom cylinder or part of the vehicle/carrier. It is easily understood that this bar or log has to be of considerable dimension to withstand the stress from the boom and bucket—especially for mining loaders. Sometimes even two persons are required to put the bar/log in place. It is also easily understood that the positioning of the bar/log and subsequent lowering of the boom is dangerous, since the bar/log may move under the stress from the boom causing the boom to lower abruptly.

U.S. Pat. No. 4,355,944 discloses an arrangement on a front end loader with a lock pin being manually inserted in apertures arranged in supports on the vehicle frame. The lock pin can be secured in the aperture by way of a retainer pin. The retainer pin is also used to keep the lock pin in a storage bracket. This arrangement involves manually lifting of the pin from its storage to its locking position and contains several small parts, which makes the arrangement both heavy to handle for the driver (it may be difficult to lift a heavy pin and fit it into the aperture) as well as delicate—not suitable for a rough environment.

U.S. Pat. No. 3,730,362 discloses a skid steer loader provided with a locking mechanism, comprising a rather complicated link mechanism for movement of a pair of pins. Such link mechanism, adapted for a small skid steer loader, will not be suitable for a loader in rough and dirty environments such as mines.

The problem with known locking arrangements is that they are not secure enough for the driver, heavy to handle and/or not suitable for heavy loaders in a rough environment.

BRIEF DESCRIPTION

The main object of the present invention is to obtain a locking arrangement for a loader that permits the driver to keep a boom arm in a elevated position in an effortless and safe manner. This is solved by the features set forth in the characterizing portion of the independent claim. Preferred embodiments are set forth in the dependent claims.

According to a main aspect, the present invention relates to a boom uplock arrangement for a loader, said loader comprising a least one movable boom arm and a support means, wherein the boom arm is provided with a horizontal, transversal through going hole, and a locking pin movably arranged in the hole. The locking pin is elongated, and having a first and a second end. The locking pin is movable in its longitudinal direction between a passive and an active position; wherein the passive position of the locking pin enables movement of the boom arm past the support means, and the active position of the locking pin prevents movement of the boom arm past the support means. The invention is characterized in that the locking pin is provided with a protruding manoeuvre stick arranged in the vicinity of the first end of the locking pin, enabling manoeuvring of the locking pin between the passive and active positions.

According to another aspect, the invention relates to an arrangement characterized in that a tubular housing is arranged to one side of the boom arm, the tubular housing is provided with a slot, the manoeuvre stick is movable within said slot, and that the slot has parts being parallel and transversal respectively with the longitudinal direction of the locking pin.

According to further aspect, the invention relates to an arrangement characterized in that a biased spring mechanism is provided in the housing applying a force to the locking pin in the longitudinal direction of the locking pin, for assisting movement of the locking pin from its passive to active position.

One advantage with an arrangement according to the invention, is that the driver not has to lift the heavy pin in place, nor worry about the pin not being accurately placed, since the locking pin is stored in a hole of the boom arm, and is movable in its longitudinal direction between a passive and an active position.

Another advantage is that the pin can be safely secured in its active and/or passive positions by way of the cooperation between the slot and the stick.

Further, the spring mechanism helps the driver to move the pin to its active position, as well as preventing the stick from moving in the slot, thereby further securing the pin in its positions.

These and other aspects of, and advantages with the present invention will be apparent from the detailed description and the accompanying drawings.

SHORT DESCRIPTION OF DRAWINGS

In the detailed description of the present invention reference will be made to the accompanying drawings, wherein, FIG. 1 shows a schematic view of a loader, arms shown in lowered and elevated positions FIG. 2 shows a cross section of an arrangement according to one embodiment of the invention, the locking pin being in a passive position, FIG. 3A is a partial cross section of an arrangement according to another embodiment of the invention, the locking pin being in a passive position and manoeuvre stick secured, FIG. 3B shows the manoeuvre stick somewhat retracted and the locking pin being in a passive position, FIG. 3C shows the locking pin in an active position, FIG. 4A shows a perspective view of two boom arms, each provided with an arrangement according to the inverition being in an active position.

DETAILED DESCRIPTION

Figure 1:
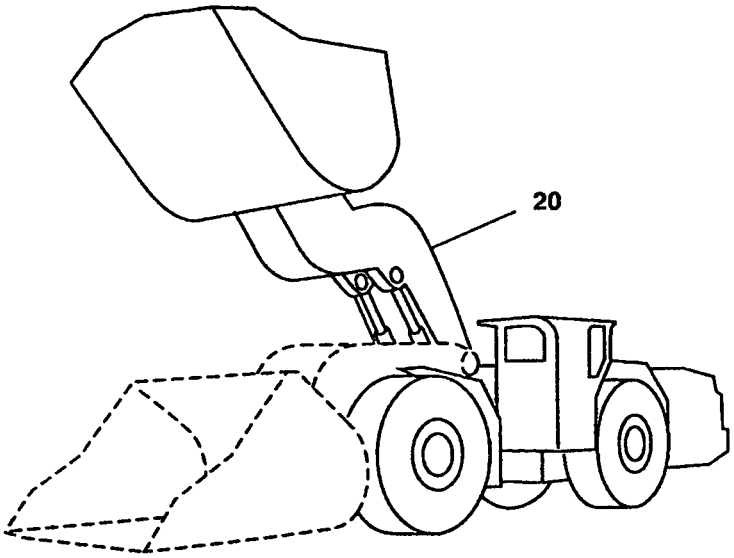

FIG. 1 shows a schematic view of a loader vehicle such as a scooptram, front loader etc., the loader having two boom arms 20, each provided with an arrangement according to the invention. A loader generally comprises a least one movable boom arm 20 and a support means 70. Hereinafter, reference will be made to one arm and an accompanying locking arrangement.

The support means 70 may be part of the vehicle frame, or be separately attached to the vehicle frame. The boom arm 20 may be pivotally supported to the vehicle carrier frame. The boom arm 20 is used with some kind of loading equipment, such as e.g. a bucket or fork, to lift some kind of load.

Figure 2:
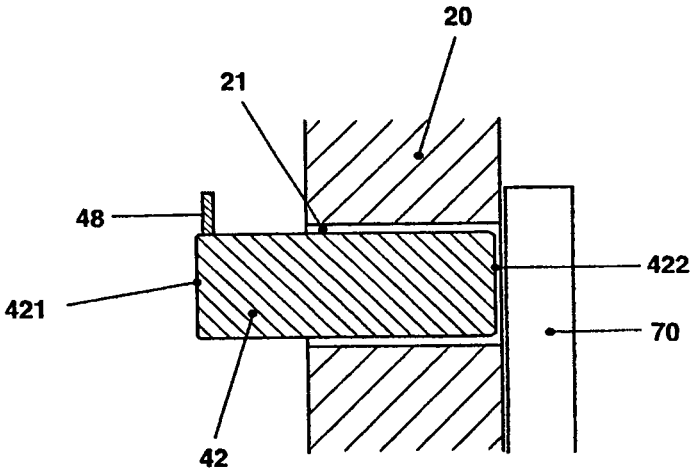

According to a first embodiment and with reference to FIG. 2, the boom arm 20 is provided with a horizontal, transversal through going hole 21, and a locking pin 42 movably arranged in the hole 21.

Preferably, the cross sections of the hole 21 and the locking pin 42 are suitably adapted to fit each other, i.e. they have the same geometrical cross sectional shapes.

The locking pin 42 is elongated, and having a first 421 and a second 422 end. The locking pin 42 may be essentially circular cylindrical, and may be rotatably movable in the hole 21.

The locking pin 42 is movable in its longitudinal direction between a passive and an active position. The passive position of the locking pin 42 enables movement of the boom arm 20 past the support means 70, and the active position of the locking pin 42 prevents movement of the boom arm 20 past the support means 70.

The length of the locking pin 42 is such that the second end 422 does not protrude from the boom arm 20 when in its passive position, and such that the second end 422 does protrude from the boom arm 20 when in active position enabling engagement with the support means 70. The length of the locking pin 42 may be chosen to be larger than the width of the boom arm 20. The dimensions of the locking pin, the hole, the support and the other constructional parts of the arrangement are chosen depending on material and stress.

The locking pin 42 is preferably provided with a protruding manoeuvre stick 48 handle) arranged in the vicinity of the first end 421 of the locking pin 42, enabling manoeuvring of the locking pin 42 between the passive and active positions. Thus, a driver can move the locking pin 42 from its passive to its active position and vice versa by way of the stick 48.

Figure 3A:
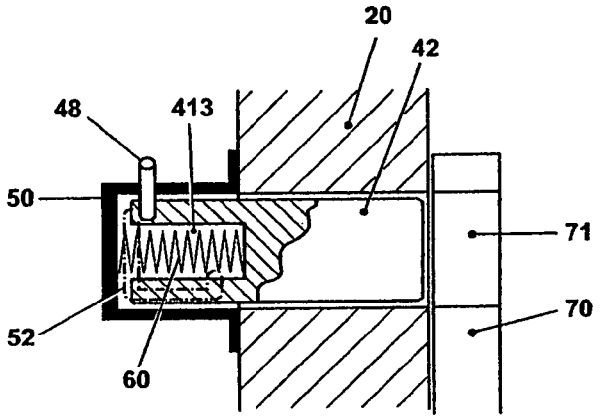
Figure 3B:
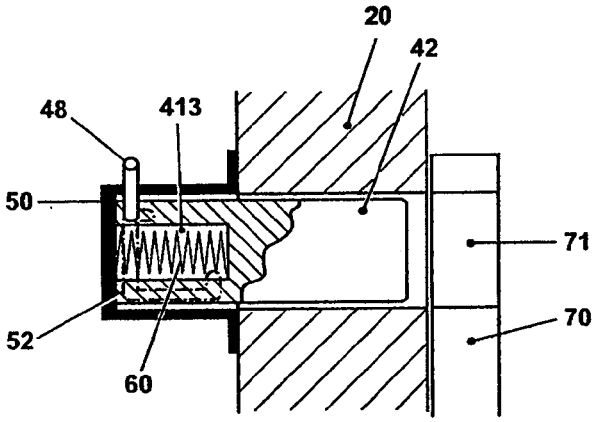
Figure 3C:
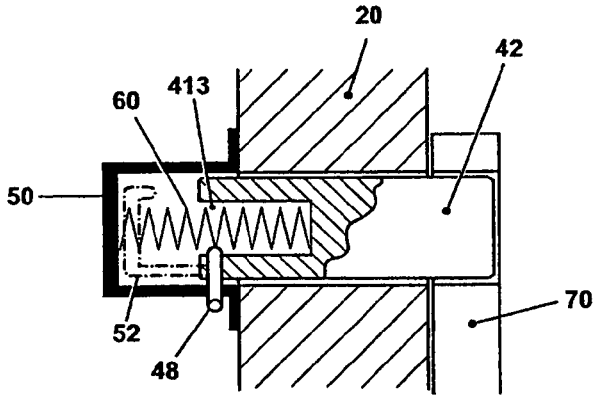

According to another embodiment shown FIG. 3A-3C, a tubular housing 50 is arranged at one side of the boom arm 20 in connection with the hole 21, and essentially enclosing the first end 421 of the locking pin 42. The housing 50 may be attached to the boom arm 20 by screws, welding or any other suitable means.

The tubular housing 50 may be provided with a slot 52, and the manoeuvre stick 48 of the locking, pin 42 is movable within said slot 52. Thereby, the slot 52 acts as a guiding for the locking pin 42. It is possible to design the housing 50 in another form than tubular, although a tubular form may be preferable from a constructional point of view.

At least one part of the slot 52 is parallel with the longitudinal direction of the locking pin 42, enabling the stick 48 to be moved in the longitudinal direction of the locking pin 42, and in turn enabling longitudinal manoeuvring of the locking pin 42.

At least one second part of the slot 52 may be transversal to the first slot part, enabling transversal movement of the stick 48, and rotation of the locking pin 42. By moving the stick 48 transversally from the longitudinal part of the slot 52, the stick 48 will be obstructed from moving in the longitudinal part of the slot 52, thus securing the locking pin 42 in a desired longitudinal position.

The outer end portion (short side) of the housing 50 (the end portion attached to the arm 20 being the inner end portion) may be partly or completely closed.

The slot 52 may be arranged in the side portion of the housing 50, but may also be partly arranged in the outer short side.

A biased spring mechanism 60 may be provided in the housing 50, applying a force to the locking pin 42 in the longitudinal direction of the locking pin 42 directed towards said second end 422, for assisting movement of the locking pin 42 from its passive to active position. Preferably, the spring mechanism 60 is arranged such that it applies a force to the locking pin 42 even when the pin 42 is in its active position. Thus, the force of the spring mechanism 60 is in addition used for securing the locking pin 42 both in the passive and active positions.

The spring mechanism 60 may be a helical spring, or any other suitable spring mechanism.

The first end 421 of the locking pin 42 may be provided with a cavity 413 for receiving at least part of the spring mechanism 60.

The housing 50 acts as support for the spring mechanism 60 and guiding means for the stick 48, and at the same time protects the locking pin 42 against dust and dirt.

Figure 5:
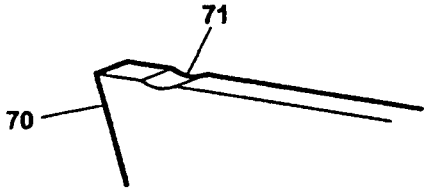
FIG. 5 shows a detailed view of a support means according to one embodiment of the invention.

The support means 70 may be provided, with a groove 71 with mating fit for receiving the locking pin 42 (FIG. 5).

Further securing arrangements may be provided for the locking pin 42 in a certain longitudinal position—either its passive or active position. The securing mechanism may be provided as e.g. additional slot parts creating a "labyrinth" for the stick 48, or keys, hasps or the like, using the force of the spring mechanism 60, obstructing the stick 48 from moving in the longitudinal part of the slot 52.

The boom arm 20 may be provided with reinforcements and further guide means for the locking pin 42.

Reference will now be made to the embodiment shown in to FIGS. 3A-3B and 4, wherein the locking pin 42 has a circular cylindrical shape, and is rotatably movable in the hole 21 of the arm 20. A housing 50 is arranged to the arm 20, being provided with a slot 52, wherein one part of the slot 52 is parallel with the longitudinal direction of the locking pin 42, and second slot part being transversal to the first slot part. Further, the slot 52 has a second longitudinal part for securing the pin 42 in passive position, and a second transversal part for securing the pin 42 in active position. A biased helical spring 60 is provided in the housing 50, and the locking pin 42 is arranged with a cavity 413 for receiving the spring 60.

When the driver uses the loader to lift some kind of material—arms moving up and down—the locking arrangement is secured in its passive position (FIG. 3A). The locking pin 42 is retracted, its second end 422 is housed in the hole 21 of the boom arm 20, and the locking pin 42 is secured in that position by way of the stick 48 cooperating with the slot 52 and effected by the force of the spring mechanism 60.

If the driver needs to perform some maintenance beneath the arm 20 of the loader, the driver will raise the arm 20 above the support means 70 and activate the locking arrangement, starting by releasing the stick 48 from its secured position by retracting it somewhat (FIG. 3B), transversally moving the stick 48 to the longitudinal part of the slot 52, thereby enabling easy manoeuvring of the locking pin 42 in its longitudinal direction towards the active position of the locking pin 42. The biased spring 60 helps the driver in the longitudinal movement of the pin 42 by pushing the locking pin 42 longitudinally towards the active position. The force of the spring mechanism 60 prevents the locking pin 42 from unintentionally leaving its active position and returning to the passive position.

Figure 4A:
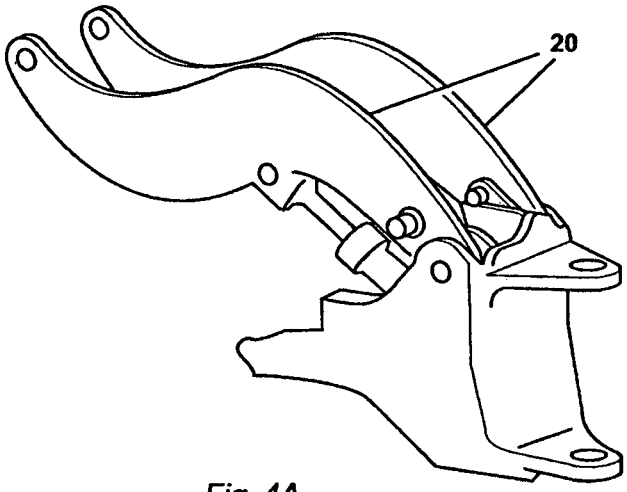
FIG. 4B is a detailed view of FIG. 4A
Figure 4B:
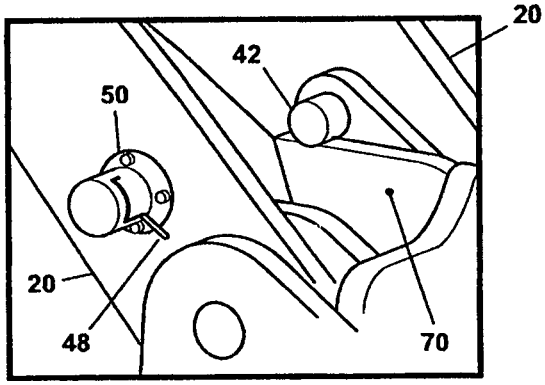

Being in its active position (FIG. 3C), the locking pin 42 protrudes from the boom arm 20 enabling engagement with the support 70 when the arm 20 is lowered from its elevated position (FIGS. 4A and B). The protruded locking pin 42 will engage with the support means 70, thereby preventing the boom arm 20 to move past the support means 70. The driver may now perform the maintenance without having to worry about the arm falling down.

Thus, the force from the spring 60 and the design of the slot 52 together keeps the locking pin 42 securely in its passive and active positions respectively by way of the stick 48. If the slot 52 is provided with an additional transversal slot part at the inner end of the housing 50, the stick 48 may be introduced in that slot part, whereby the locking pin 42 can be secured in its active position.

When the driver is finished, he/she raises the arm 20, retracts the locking pin 42 by moving the stick 48 in the slot until the locking pin 42 is secured in its passive position (the spring 60 is pressed together). Thus, the locking pin 42 is again retracted and its second end 422 is housed in the hole 21, enabling the boom arm 20 to freely move past the support means 70.

It is possible to provide another part of the loader with a locking arrangement according to the invention, e.g. the locking arrangement may be arranged to the plate instead of to the arm.

The arrangement according to the invention is preferably arranged so that the stick is manoeuvrable from the outer side of the arm/arms for easy access. The stick is suitably arranged in such way that it is visible from the drivers seat, when being in one or the other position.

The stick and/or pin may also be painted in a colour different from the surrounding parts, and the intended positions for the stick may be marked—making it even more clear for the driver to determine in which position the locking pin is.

The loader shown is a mining loader, but the present invention can of course be applied to any kind of loader or vehicle having need for a simple and safe uplock arrangement of the arms or another part of the vehicle.

The embodiments shown in the drawings and put forward in the description should not be considered restricting, only as exemplifying.

The invention claimed is:

1. A mining loader comprising a boom including at least one movable boom arm (20) and a support means (70), wherein the boom arm (20) is provided with a manually operated uplock arrangement comprising:

a horizontal, transversal through going hole (21) defined directly in said at least one movable boom arm, and a locking pin (42) movably arranged in the hole (21), the locking pin (42) being elongated and having a first (421) and a second (422) end, the locking pin (42) being movable in a longitudinal direction between a passive and an active position; wherein in the passive position the locking pin (42) enables movement of the boom arm (20) past the support means (70), and in the active position the locking pin (42) acts as a stop for preventing movement of the boom arm (20) past a predetermined position on the support means (70), said hole in said at least one boom arm provided for both storing said locking pin in said passive position and for guiding said locking pin between said passive and active positions, wherein the locking pin (42) is provided with a maneuver stick (48) extending directly from said locking pin and arranged in the vicinity of the first end (421) of the locking pin (42), enabling maneuvering of the locking pin (42) between the passive and active positions, wherein said maneuver stick is selectively movable in a slot arranged for removably securing said locking pin in at least one of said active or said passive positions, and said loader further including a housing arranged on the boom arm, wherein said slot is defined in said housing.

2. The loader according to claim 1, wherein said housing, is tubular and is arranged at one side of the boom arm (20) over the hole (21), and essentially enclosing the first end (421) of the locking pin (42).

3. The loader according to claim 1, wherein at least a first part of the slot (52) is parallel with the longitudinal direction of the locking pin (42).

4. The loader according to claim 3, wherein at least a second part of the slot (52) is oriented transverse to the first part of the slot, enabling transverse movement of the maneuver stick (48).

5. The loader according to claim 1, wherein the locking pin (42) has a circular cylindrical shape, and is rotatably movable in the hole (21).

6. The loader according to claim 1, wherein a biased spring mechanism (60) is provided in the housing (50) for applying a force to the locking pin (42) in the longitudinal direction of the locking pin (42), for assisting movement of the locking pin (42) from said passive to said active position.

7. The loader according to claim 6, wherein the spring mechanism (60) is a helical spring.

8. The loader according to claim 6, wherein the first end (421) of the locking pin (42) defines a cavity (413) for receiving the spring mechanism (60).

9. The loader according to claim 1, wherein the support means (70) is provided with a groove (71) with mating fit for receiving the locking pin (42).

10. A mining loader comprising a boom including at least one movable boom arm (20) and a support means (70), wherein the boom arm (20) is provided with a manually operated uplock arrangement comprising:

a horizontal, transversal through going hole (21) defined directly in said at least one movable boom arm, and a locking pin (42) movably arranged in the hole (21), the locking pin (42) being elongated and having a first (421) and a second (422) end, the locking pin (42) being movable in a longitudinal direction between a passive and an active position; wherein in the passive position the locking pin (42) enables movement of the boom arm (20) past the support means (70), and in the active position the locking pin (42) acts as a stop for preventing movement of the boom arm (20) past a predetermined position on the support means (70), said hole in said at least one boom arm provided for both storing said locking pin in said passive position and for guiding said locking pin between said passive and active positions, wherein the locking pin (42) is provided with a maneuver stick (48) extending directly from said locking pin and arranged in the vicinity of the first end (421) of the locking pin (42), enabling maneuvering of the locking pin (42) between the passive and active positions, wherein said slot has two sections, one of said sections arranged to removably secure said locking pin in said active position, the other of said sections arranged to secure said locking pin in said passive position, said loader further including a housing arranged on the boom arm, wherein said slot is defined in said housing.

11. The loader according to claim 10, wherein said housing is tubular and is arranged at one side of the boom arm (20) over the hole (21), and essentially enclosing the first end (421) of the rocking pin (42).

12. The loader according to claim 10, wherein a first one of said sections of said slot is parallel with the longitudinal direction of the locking pin (42).

13. The loader according to claim 12, wherein another one of said sections of said slot is oriented transverse to the first section of the slot, enabling transverse movement of the maneuver stick (48).

14. The loader according to claim 10, wherein the locking pin (42) has a circular cylindrical shape, and is rotatably movable in the hole (21).

15. The loader according to claim 10, wherein a biased spring mechanism (60) is provided in the housing (50) for applying a force to the locking pin (42) in the longitudinal direction of the locking pin (42), for assisting movement of the locking pin (42) from said passive to said active position.

16. The loader according to claim 15, wherein the spring mechanism (60) is a helical spring.

17. The loader according to claim 15, wherein the first end (421) of the locking pin (42) defines a cavity (413) for receiving the spring mechanism (60).

18. The loader according to claim 10, wherein the support means (70) is provided with a groove (71) with mating fit for receiving the locking pin (42).

* * * * *

UNITED STATES PATENT AND TRADEMARK OFFICE

CERTIFICATE OF CORRECTION

PATENT NO. : 9,062,435 B2
APPLICATION NO. : 11/922998
DATED : June 23, 2015
INVENTOR(S) : Roger Hylen It is certified that error appears in the above-identified patent and that said Letters Patent is hereby corrected as shown below:

In the specification

Column 3, Line 55: Delete “handle)” and substitute --(handle)--.

In the claims

Column 7, Line 17 (Claim 11, Line 4): Delete “rocking” and substitute --locking--.

Signed and Sealed this
Sixth Day of October, 2015

Michelle K. Lee

Michelle K. Lee
*Director of the United States Patent and Trademark Office*